US007124820B2

(12) United States Patent
Wardlaw

(10) Patent No.: US 7,124,820 B2
(45) Date of Patent: Oct. 24, 2006

(54) EXOTHERMIC TOOL AND METHOD FOR HEATING A LOW TEMPERATURE METAL ALLOY FOR REPAIRING FAILURE SPOTS ALONG A SECTION OF A TUBULAR CONDUIT

(76) Inventor: Louis J. Wardlaw, c/o Hot-Hed Inc. 5322 Addicks-Satsuma Rd., Houston, TX (US) 77284

( * ) Notice: Subject to any disclaimer, the term of this patent is extended or adjusted under 35 U.S.C. 154(b) by 13 days.

(21) Appl. No.: 10/924,117

(22) Filed: Aug. 20, 2004

(65) Prior Publication Data

US 2006/0037750 A1 Feb. 23, 2006

(51) Int. Cl.
*E21B 36/04* (2006.01)
*E21B 36/02* (2006.01)

(52) U.S. Cl. ..... 166/277; 166/59; 166/60; 166/302

(58) Field of Classification Search ..... None
See application file for complete search history.

(56) References Cited

U.S. PATENT DOCUMENTS

2004/0146288 A1* 7/2004 Vinegar et al. ..... 392/301

* cited by examiner

*Primary Examiner*—Zakiya W. Bates
(74) *Attorney, Agent, or Firm*—William C. Norvell, Jr.

(57) ABSTRACT

An exothermic well tool and method of use for the repair of failure spots along a section of a first tubular conduit, such as casing, wherein the housing of the tool is heated to at least a temperature approximately in excess of that required to activate and melt an exothermic metal alloy composition and may include an ignitable starter fuel charge with a series of solid activation fuel charges spaced throughout the chamber. The tool may also include a length of a second tubular conduit for positioning around the exterior of the housing to define an annular area relative to the first tubular conduit for deposit of a low temperature metal alloy therein.

5 Claims, 2 Drawing Sheets

EXOTHERMIC TOOL AND METHOD FOR HEATING A LOW TEMPERATURE METAL ALLOY FOR REPAIRING FAILURE SPOTS ALONG A SECTION OF A TUBULAR CONDUIT

BACKGROUND OF THE INVENTION (1.) Field of the Invention

The invention relates to an apparatus and method for the repair of failure spots along a first tubular conduit, such as casing, in a subterranean well.

(2.) Brief Description of the Prior Art

Subterranean wells, such as oil, gas or water wells, oftentimes are completed with the introduction and cementing in place a long string of tubular sections of metallic casing. Since the expected production life of such a well has been known to last decades, and in view of the fact that the abrasive well fluids and treatment chemicals flowing interiorally of the casing often result in defects, such as small holes, pock marks leading to small holes and cracks, ("failure spots") it is not at all surprising that a failure in circulation of the fluids oftentimes results, with the holes eventually getting larger and larger and even penetrating through the cement securing the casing within the well. It is therefore necessary from time to time to inspect the casing for such defects and attempt to repair them, as opposed to retrieving the entire casing string and running and setting another string of casing.

The present invention addresses the problems as set forth above.

SUMMARY OF THE INVENTION

The present invention provides an exothermic well tool and method for heating a low temperature metal alloy for the repair of failure spots along a section of a first tubular conduit, such as, for example, casing. The well tool comprises an elongated heat conducting housing having a cylindrical interior chamber. The interior of the chamber is heated by an electrically ignitable fuel system and the heat is transferred through the housing and into a low temperature eutectic metal alloy composition previously deposited within the well. The eutectic alloy composition is caused to melt and free flow within the well to seek the failure spots and plug or otherwise treat them to abate the failures. Preferably, means are provided at one end of the housing for introducing, positioning and retrieving the tool within the well. An electrically ignitable starter fuel charge is placed within the chamber. Means are provided for electrically igniting the starter fuel charge. Throughout the interior of the housing are disposed a series of solid activation fuel charges. A primary slow burning ignition fuel charge surrounds the solid fuel activation charges and is ignited by the solid fuel activation charges.

Prior to igniting the fuels within the tool, the tool is placed in alignment in the well for straddling the particular failure spot or spots. A second tubular conduit, or repair conduit section, is run into place in the annular area between the exterior of the housing of the tool and the interior of the first conduit member. The lowermost end of this second or repair conduit includes a retaining seal extending outwardly for sealing contact with the interior of the first conduit member. After the second or repair conduit is in place, and the well tool housing are run to location, a fluid containing a low temperature melting, or eutectic, alloy is placed into the annular area above the seal and between the exterior of the well tool housing and the interior of the casing section to be repaired. As the eutectic alloy is slowly melted during activation of the well tool, the alloy in the fluid flow and the failure spots are plugged and sealed. Thereafter, the well tool housing is retrieved from the well and the second tubular string, or repair section, may be left in the well to straddle the failure spots, leaving the original casing intact with the failure spots repaired and the casing integrity enhanced for normal subterranean operations. If desired, the second tubular string of casing or tubing may be perforated thereafter if the repaired section is within a producing zone or section of the well.

DESCRIPTION OF THE PREFERRED EMBODIMENTS

Figure 1:
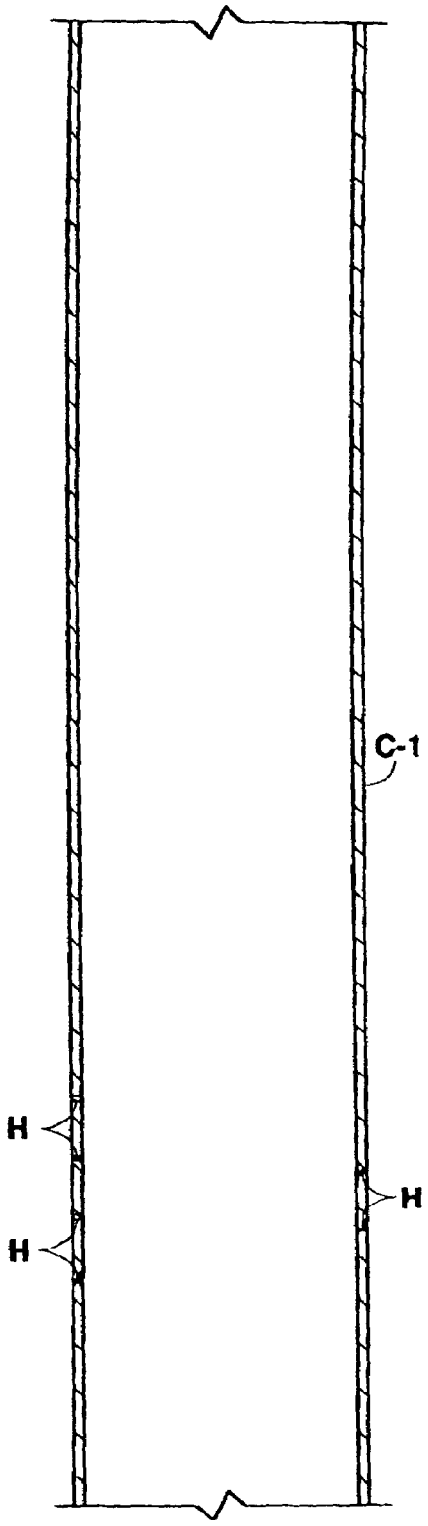
FIG. 1 is a vertical longitudinal sectional schematic view of a section of casing including failure spots to be repaired.
Figure 2:
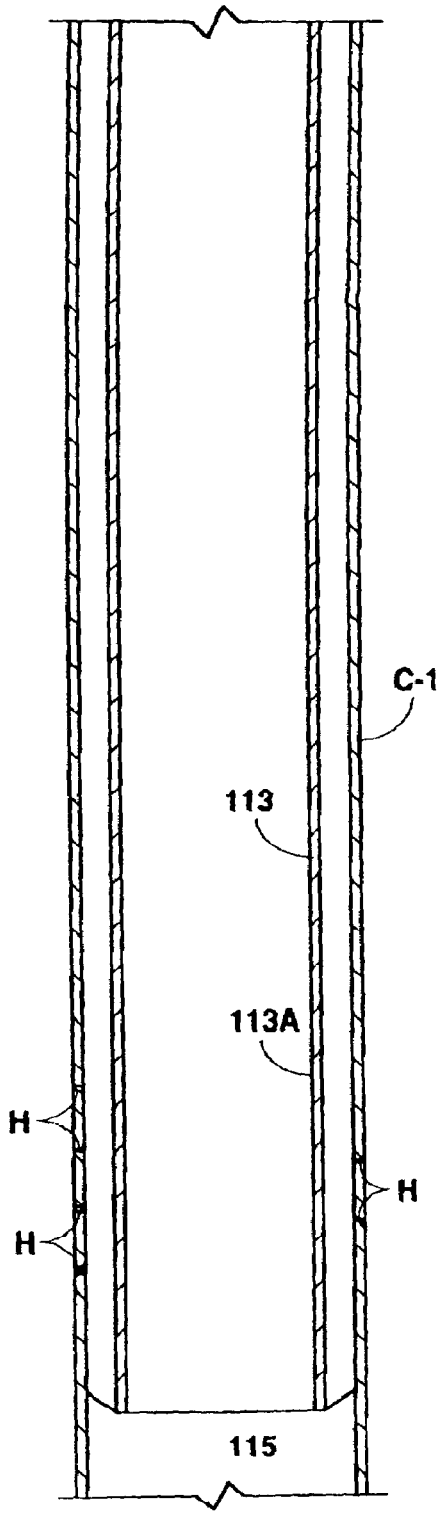
FIG. 2 is a view similar to that of FIG. 1, illustrating the insertion of the second, or repair, tubular conduit with a retainer seal disposed at its lower end to form an annular area between the second conduit and the interior of the casing.
Figure 3:
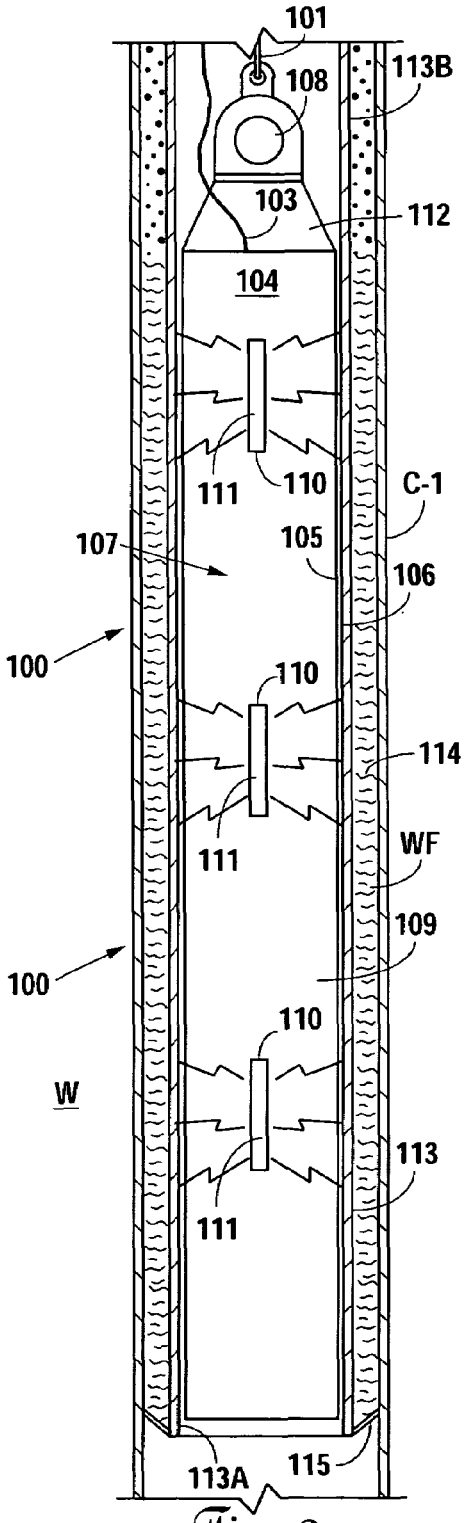
FIG. 3 is an illustration similar to that of FIGS. 1 and 2, and depicting through vertical cross-section the well tool housing including the various fuel deposits.
Figure 4:
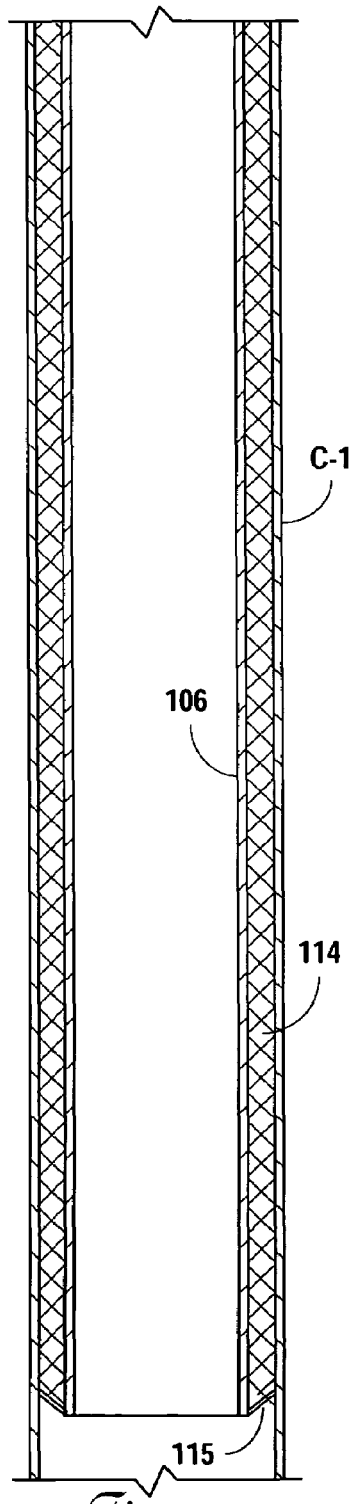
FIG. 4 is an illustration similar to that of FIG. 1, illustrating the repaired casing conduit after the well tool housing has been retrieved, the failure spots repaired, and the secondary conduit retrieved.

Now referring to FIG. 1, there is shown a subterranean well W. The well W includes previously run and set a first conduit string or casing C-1. As shown the casing string C-1 has a series of small holes or defects H located longitudinally and radially around a section of the casing C-1.

As shown in FIG. 1 the apparatus 100 of the present invention is preferably run into the well W on wire line 101, of conventional and known nature. Alternatively, it may be run into the well W on tubing or electric line. If means other than electric line are used to run and set the apparatus 100, an electric line 103 is provided form the top of the well W and connected to a source of electric energy at the top or other location in the well W and is connected at the lower end to an electric starter charge 104 within an upper starter charge chamber section 105 within an elongated heat conducting housing 106. The housing preferably is made of metal, such as an alloy steel or the like. The major requirement for the construction of the housing 106 is that it is enabled to conduct, or transfer, heat, sufficiently to melt the exteriorally deposited eutectic alloy material, discussed in detain below. The chamber section 105 is the uppermost portion of a continuing cylindrical interior chamber 107 defined within the interior of the housing 106. A one-way check valve 108 is positioned at the upper end of the housing 106 to vent pressure exceeding a pre-set limit within the housing 106 during ignition of the various fuels required to activate the apparatus 100.

The housing 106 contains a primary, slow burning, homogeneous stabilized ignition fuel charge 109, which may have an additive in it to avoid the formation of an iron precipitant, in order to avoid a reaction which will burn a hole through the lower end of the housing 106. Any commercially available source of a mixture of iron oxide and aluminum which is used in, for example, explosives for perforating guns or like actuations within a subterranean well, may be used. Additives which assist in the burning of a material under water, such as boron nitrate may also be added. The fuel charge 109 may also include an additive such as magnesium for more controlled burning. The aluminum may be finely ground to increase the rate of burn. However, it is preferable to retard the burn rate of this fuel 109 so that energy is not lost in the exhaust. To control the rate of burn of the fuel 109 to achieve maximum burn without excessive exhaust loss, a binder, such as starch, may be added to slow the rate of burn, as well as an additive that expands upon heating to raise the melting point of the fuel mixture charge 109 and to permit the fuel charge 109 to harden quickly as it is introduced into the chamber 107. Such expansion and hardening agents are commercially available from a host of sources and are well known to those skilled in the fuel composite arts for well tool usage. An additive, such as a dispersant, may also be provided to keep iron particles moving in the fuel mixture charge 109 so that they do not decant to the bottom of the fuel charge 109 but react and hit the matrix and "freeze" in place such that iron pellets are scattered through the fuel charge 109 instead of providing an iron plate at the bottom of the chamber 107 at the bottom of the housing 106.

Interspaced longitudinally and radially within the fuel charge 109 are a series of solid activation fuel charges 110 in tubular housing 111. The tubular housings 111 may be made of any material that will contain activation fuel charge 110 and separate it from the primary fuel charge 109, yet quickly burn at a relatively low temperature to permit the fuel charges 109 to disperse quickly into the primary fuel charge 109. Thus, the tubular housings 111 may be made of a light cardboard of known construction. Again, the particular primary fuel charge will be well known to those skilled in these arts and are commercially available.

The primary fuel charge 109 is topped off with an electrically ignitable starter fuel charge 112 within the uppermost end or portion of the chamber 107. The starter fuel charge composition may be one of a number of commercially available fuels well known to those skilled in these arts.

The method and apparatus of the present invention may also include a length of second tubular conduit 113 having first and seconds 113-A, 113-B and introduceable within the well W for positioning within the well W exteriorally around the housing 111. An annular area 114 is defined within the well W and interiorally of the first tubular conduit C-1 for deposit of a low temperature metal alloy eutectic composition EC. The eutectic composition EC is placed in the annulus area 114 in the form of pellets, in a carrier fluid. The word "eutectic" describes an alloy, which, like pure metals, has a single melting point. This melting point is usually lower than that of any of the constituent metals. Thus, for example, pure Tin melts at 449.4 degrees F., and pure Indium melts at 313.5 degrees F., but combined in a proportion of 48% Tin and 52% Indium, they form a eutectic which melts at 243 degrees F. Generally speaking, the eutectic alloy of the present invention will be a composition of various ranges of Bismuth, Lead, Tin, Cadmium and Indium. Occasionally, if a higher melting point is desired, only Bismuth and Tin or Lead need be used. The chief component of this composition EC is Bismuth, which is a heavy coarse crystalline metal that expands when it solidifies. Water and Antimony also expand but Bismuth expands much more than the former, namely 3.3% of its volume. When Bismuth is alloyed with other materials, such a Lead, Tin, Cadmium and Indium, this expansion is modified according to the relative percentages of Bismuth and other components present. As a general rule, Bismuth alloys of approximately 50 percent Bismuth exhibit little change of volume during solidification. Alloys containing more than this tend to expand during solidification and those containing less tend to shrink during solidification. After solidification, alloys containing both Bismuth and Lead in optimum proportions grow in the solid state many hours afterwards. Bismuth alloys that do not contain Lead expand during solidification, with negligible shrinkage while cooling to room temperature.

Most molten metals when solidified in molds or annular areas shrink and pull away from the molds or annular areas or other containers. However, eutectic fusible alloys expand and push against their container when they solidify and are thus excellent materials for use as plugging agents for correcting failure spots in well tubular conduits, such as casing.

The second tubular conduit 113 has proximate its first or lower end 113-B a retaining seal means 115 for sealing the low temperature metal alloy in the annular area 114 and preventing it from being deposited in the well W below the area containing the failure spots or defects H.

OPERATION

After the casing C-1 has been inspected and found to have failure spots or defects H, The second tubular string of casing 113 is run into place. Thereafter, the housing 106 of the apparatus 100 is run into the well W on conventional tubing, coiled tubing, wire line, or the like to a location where it straddles the area of the casing C-1 containing the failure sport H. The annular area 114 is then filled with a carrier fluid containing the eutectic alloy EC. Thereafter, the respective charges are remotely activated which, in turn, ignites the quick fuel spot charges 110 which, in turn, heats and burns the slow stabilized fuel 109, resulting in the high energy heating of the housing 106. This heat is then transferred into the eutectic alloy EC to melt it such that it flows and seeks the defects H and plugs or bridges them to enhance the integrity of the casing C-1. Thereafter, the housing 106 is removed from the well W and perforation through the second tubular conduit 113, or normal production operations, may be continued.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

The invention claimed is:

1. An exothermic well tool for heating a low temperature metal alloy deposited in the well for the repair of failure spots along a section of a first tubular conduit, comprising:

(a) an elongated heat conducting housing having a cylindrical interior chamber;

(b) means at one end of said housing for introducing, positioning and retrieving said tool within said well;

(c) an electrically ignitable fuel system within said chamber;

(d) means for remotely igniting the fuel system, whereby, upon activation of the igniting means, the fuel system is ignited sufficient to heat the housing for conduction of said heat sufficient to melt the said eutectic alloy in the well along and within said failure spots.

2. An exothermic well tool for heating a low temperature metal alloy deposited in said well for the repair of failure spots along a section of a first tubular conduit, comprising:

(a) an elongated heat conducting housing having a cylindrical interior chamber;

(b) means at one end of said housing for introducing, positioning and retrieving said tool within said well;

(c) an ignitable starter fuel charge within the chamber;

(d) means for remotely igniting the starter fuel charge;

(e) a series of solid activation fuel charges spaced throughout the chamber of said housing; and (f) a primary, slow burning ignition fuel charge disposed in said chamber surrounding the solid fuel activation charges and ignited by the solid fuel activation charges.

3. The well tool of claim 1 or claim 2, further comprising:

(a) a length of second tubular conduit having first and second ends and introduceable within said well for positioning within said well exteriorally around said housing and defining an annular area within the well and interiorally of said first tubular conduit for deposit of a low temperature metal alloy composition therein ; and (b) retaining seal means on and around the first end of said second conduit for sealing the low temperature metal alloy in the annular area thereabove.

4. The well tool of claim 1 or claim 2 further comprising a one way check valve means immediate one end of the chamber manipulatable from an initially closed position to an open position for venting of gas pressure above a predetermined value within the chamber during ignition and burn of fuel charges, and subsequently manipulatable from an open position to a closed position to isolate the chamber from fluids within the well.

5. A method of repairing failure spots along a section of a first tubular conduit within a subterranean well, comprising the steps of:

(a) introducing within the well and positioning adjacent the section of the first tubular conduit containing failure spots, a length of second tubular conduit having first and second ends and retaining seal means on and around the first end of said second conduit for sealing a low temperature alloy within an annular area defined between the first and second tubular conduits above the retaining seal means;

(b) introducing within the well an exothermic well tool for heating a low temperature metal alloy, comprising:

(c) an elongated heat conducting housing having a cylindrical interior chamber;

(d) means at one end of said housing for introducing, positioning and retrieving said tool within said well;

(e) an electrically ignitable starter fuel charge within the chamber;

(f) means for electrically igniting the starter fuel charge;

(g) a series of solid activation fuel charges spaced throughout the chamber of said housing;

(h) a primary, slow burning ignition fuel charge disposed in said chamber surrounding the solid fuel activation charges and ignited by the solid fuel activation charges;

(i) introducing said tool into the well and positioning the tool immediate the area of the section of first tubular conduit conduit including the failure spots;

(j) depositing within the annular area between the first and second tubular conduits a low temperature metal alloy;

(k) remotely igniting the starter fuel to generate sufficient heat to ignite the solid activation fuel charges and, in turn, the slow activation fuel charges;

(l) heating the housing to conduct sufficient exothermic heat within the annular area between the first and second conduits to melt the low temperature metallic alloy whereby said alloy flows and moves into the failure spots; and (m) withdrawing the housing from the well.

* * * * *